US010738797B2

(12) United States Patent
Li et al.

(10) Patent No.: US 10,738,797 B2
(45) Date of Patent: Aug. 11, 2020

(54) DRAIN PUMP AND HOME APPLIANCE COMPRISING SAME

(71) Applicant: Johnson Electric S.A., Murten (CH)

(72) Inventors: Min Li, Shenzhen (CN); Jin Sheng Chi, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 357 days.

(21) Appl. No.: 15/488,189

(22) Filed: Apr. 14, 2017

(65) Prior Publication Data

US 2017/0298960 A1 Oct. 19, 2017

(30) Foreign Application Priority Data

Apr. 15, 2016 (CN) ..... 2016 1 0235383

(51) Int. Cl.

| | |
|---|---|
| ***F04D 29/70*** | (2006.01) |
| ***F04D 29/66*** | (2006.01) |
| ***F04D 29/42*** | (2006.01) |
| ***A47L 15/42*** | (2006.01) |
| ***F04D 13/06*** | (2006.01) |
| ***F04D 29/08*** | (2006.01) |
| ***F04D 29/22*** | (2006.01) |
| *D06F 39/10* | (2006.01) |
| *D06F 39/08* | (2006.01) |

(52) U.S. Cl.

CPC ..... *F04D 29/708* (2013.01); *A47L 15/4225* (2013.01); *F04D 13/06* (2013.01); *F04D 29/086* (2013.01); *F04D 29/22* (2013.01); *F04D 29/4273* (2013.01); *F04D 29/4293* (2013.01); *F04D 29/669* (2013.01); *D06F 39/085* (2013.01); *D06F 39/10* (2013.01)

(58) Field of Classification Search

None

See application file for complete search history.

(56) References Cited

U.S. PATENT DOCUMENTS

| | | | | |
|---|---|---|---|---|
| 2004/0104158 | A1* | 6/2004 | Kim | D06F 39/085 210/295 |
| 2005/0246843 | A1* | 11/2005 | Song | D06F 39/10 8/158 |
| 2014/0238089 | A1* | 8/2014 | Jeong | D06F 39/10 68/18 F |
| 2018/0132692 | A1* | 5/2018 | Dries | F04D 29/247 |

FOREIGN PATENT DOCUMENTS

| | | | |
|---|---|---|---|
| CN | 101737559 | A | 6/2010 |
| CN | 203532316 | U | 4/2014 |
| CN | 104132002 | A | 11/2014 |

* cited by examiner

*Primary Examiner* — Cristi J Tate-Sims

(74) *Attorney, Agent, or Firm* — Muncy, Geissler, Olds & Lowe, P.C.

(57) ABSTRACT

A drain pump comprises a pump housing having a filtering cavity and an impeller cavity; a filter mounted in the pump housing and having a filter core; and a gap defined between the filter core and the pump housing to communicate the filtering cavity and the impeller cavity.

17 Claims, 14 Drawing Sheets

DRAIN PUMP AND HOME APPLIANCE COMPRISING SAME

CROSS REFERENCE TO RELATED APPLICATIONS

This non-provisional patent application claims priority under 35 U.S.C. § 119(a) from Patent Application No. 201610235383.X filed in The People's Republic of China on Apr. 15, 2016.

FIELD OF THE INVENTION

The present disclosure relates to home appliances, and in particular to a drain pump and a home appliance including the drain pump.

BACKGROUND OF THE INVENTION

A drain pump is a key component used in a washing machine and a dishwasher. Operation of the drain pump has three working states, i.e. a startup state, water draining state, and mixed air and water draining state. In the mixed air and water draining state, since most water has been drained out, only a small amount of residual water is left which is mixed with air to form a mixed fluid. As a result, the drain pump generates large noises.

SUMMARY OF THE INVENTION

Accordingly, the present disclosure provides a drain pump which can effectively reduce the noises and a washing machine including the drain pump.

The present disclosure provides a drain pump including a pump housing having a filtering cavity and an impeller cavity; a filter mounted in the pump housing and having a filter core; and a gap defined between the filter core and the pump housing to communicate the filtering cavity and the impeller cavity.

Preferably, an annular plate is disposed in the pump housing between the filtering cavity and the impeller cavity, the annular plate defines a through hole, one end of the filter core is accommodated in the through hole, and the gap is defined between the filter core and the annular plate.

Preferably, the filter core comprises a filter housing and a bent plate, the filter housing defines a filter hole, the bent plate surrounds an outer circumferential surface of the filter housing, and the gap is formed between the bent plate and the annular plate.

Preferably, an outer circumferential surface of the bent plate is provided with a plurality of protruding posts abutting against an inner surface of the annular plate.

Preferably, a baffle extends radially from the filter core, and the baffle and the annular plate are opposed to each other.

Preferably, the annular plate forms an annular protrusion extending toward to the baffle, and the annular protrusion surrounds the through hole and is opposed to the baffle.

Preferably, an annular protruding block is arranged in the baffle to face the annular plate; the annular protruding block, the baffle and the bent plate together define an annular groove; the annular protrusion is aligned with the annular groove, and the filtering cavity, the impeller cavity, the gap, and the annular groove communicate with each other.

Preferably, the bent plate abuts against the inner surface of the annular plate, the inner surface of the bent plate defines a plurality of pressure relief grooves which form the gap, and the pressure relief grooves communicate the filtering cavity with the impeller cavity.

Preferably, the pressure relief grooves are circular arc-shaped, dovetail-shaped, or serrated grooves arranged circumferentially along the inner surface of the annular plate.

Preferably, the filter core further comprises a filter mesh connected with the filter housing, and the filter mesh is disposed in one end of the filter hole opposite from the impeller cavity.

Preferably, the filter further comprises a sealing member and a plurality of connecting members, the sealing member is connected to the filter core through the connecting members, the pump housing further comprises a sealing cavity disposed at one end of the filtering cavity opposite from the impeller cavity, and the sealing member is accommodated in the sealing cavity and connected with the pump housing.

Preferably, the sealing member connected with the pump housing via a thread engagement.

Preferably, the drain pump further comprises a motor assembly including a mounting housing and a motor, the motor is mounted in the mounting housing, the mounting housing is fixedly connected to the pump housing, one end of the motor is connected with an impeller, and the impeller is accommodated in the impeller cavity.

Preferably, the motor is a single phase brushless direct current motor, a three phase brushless direct current motor, or a single phase synchronous motor.

Preferably, an inlet pipe and an outlet pipe protrude from an outer circumferential surface of the pump housing, the inlet pipe defines an inlet passage in communication with the filtering cavity, and the outlet pipe defines an outlet passage in communication with the impeller cavity.

The present disclosure also provides a home appliance including the drain pump as described above.

Preferably, the home appliance is a washing machine or a dishwasher.

In the drain pump of embodiments of the present disclosure, the gap in communication with the filtering cavity and the impeller cavity is defined between the pump housing and the filter core. Therefore, near the end of the drainage process of the drain pump, air-mixed water struck on the sidewall of the impeller cavity may flow back into the filtering cavity and the inlet passage via the gap between the filtering cavity and the impeller cavity. In this way, the air-mixed water struck on the sidewall of the impeller cavity may undergo pressure relief, thus effectively reducing the noises of the drain pump generated during the drainage process.

DETAILED DESCRIPTION OF THE PREFERRED EMBODIMENTS

The technical solutions of the embodiments of the present disclosure will be clearly and completely described as follows with reference to the accompanying drawings. Apparently, the embodiments as described below are merely part of, rather than all, embodiments of the present disclosure. Based on the embodiments of the present disclosure, any other embodiment obtained by a person skilled in the art without paying any creative effort shall fall within the protection scope of the present disclosure.

It is noted that, when a component is described to be "fixed" to another component, it can be directly fixed to the another component or there may be an intermediate component, i.e. indirectly fixed to the another component through a third component. When a component is described to be "connected" to another component, it can be directly connected to the another component or there may be an intermediate component. When a component is described to be "disposed" on another component, it can be directly disposed on the another component or there may be an intermediate component.

Unless otherwise specified, all technical and scientific terms have the ordinary meaning as understood by people skilled in the art. The terms used in this disclosure are illustrative rather than limiting. The term "and/or" as used in this disclosure means that each and every combination of one or more associated items listed are included.

The present disclosure provides a drain pump including a pump housing and a filter. The pump housing includes a filtering cavity and an impeller cavity. The filter is mounted in the pump housing. The filter includes a filter core. The filter core and the pump housing define therebetween a gap which communicates the filtering cavity with the impeller cavity.

Figure 1:
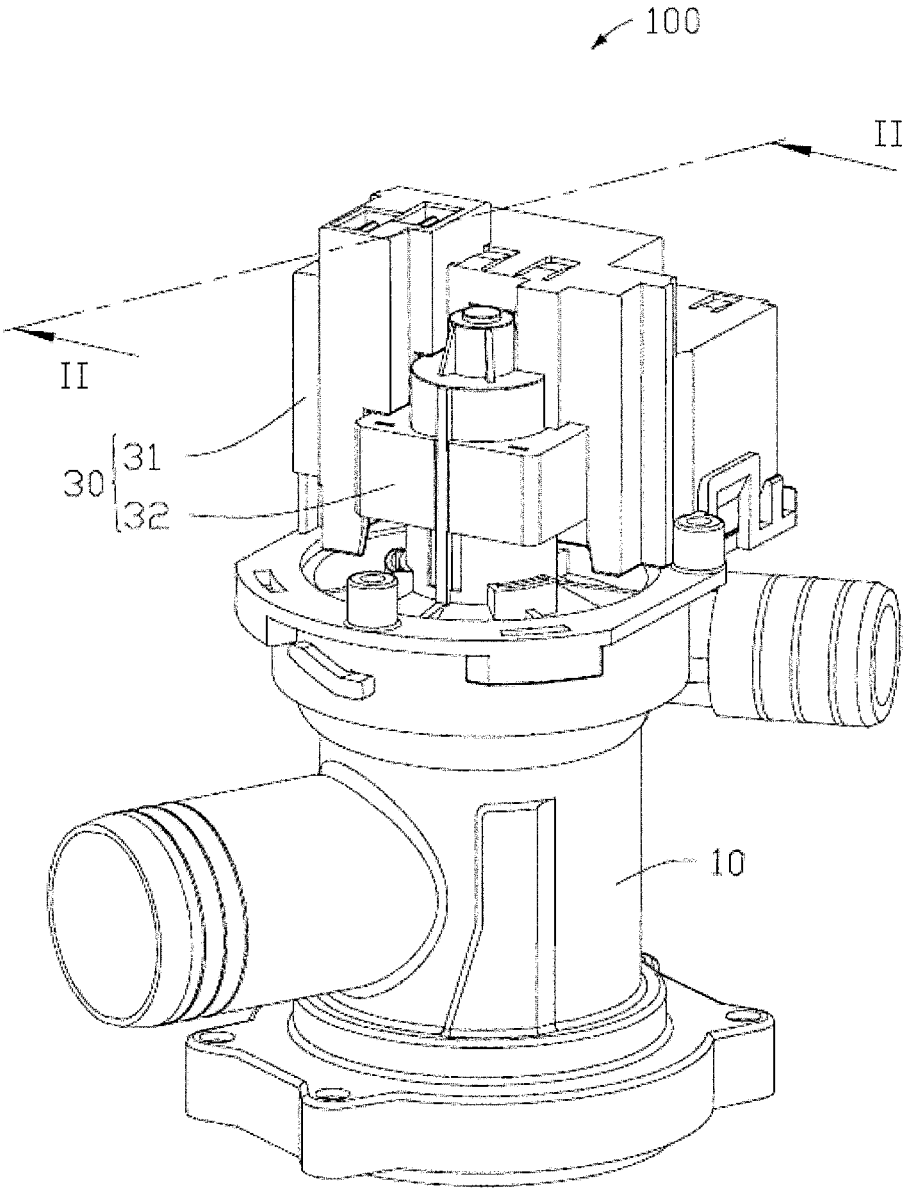
FIG. 1 is a perspective view of a drain pump according to one embodiment of the present disclosure.
Figure 2:
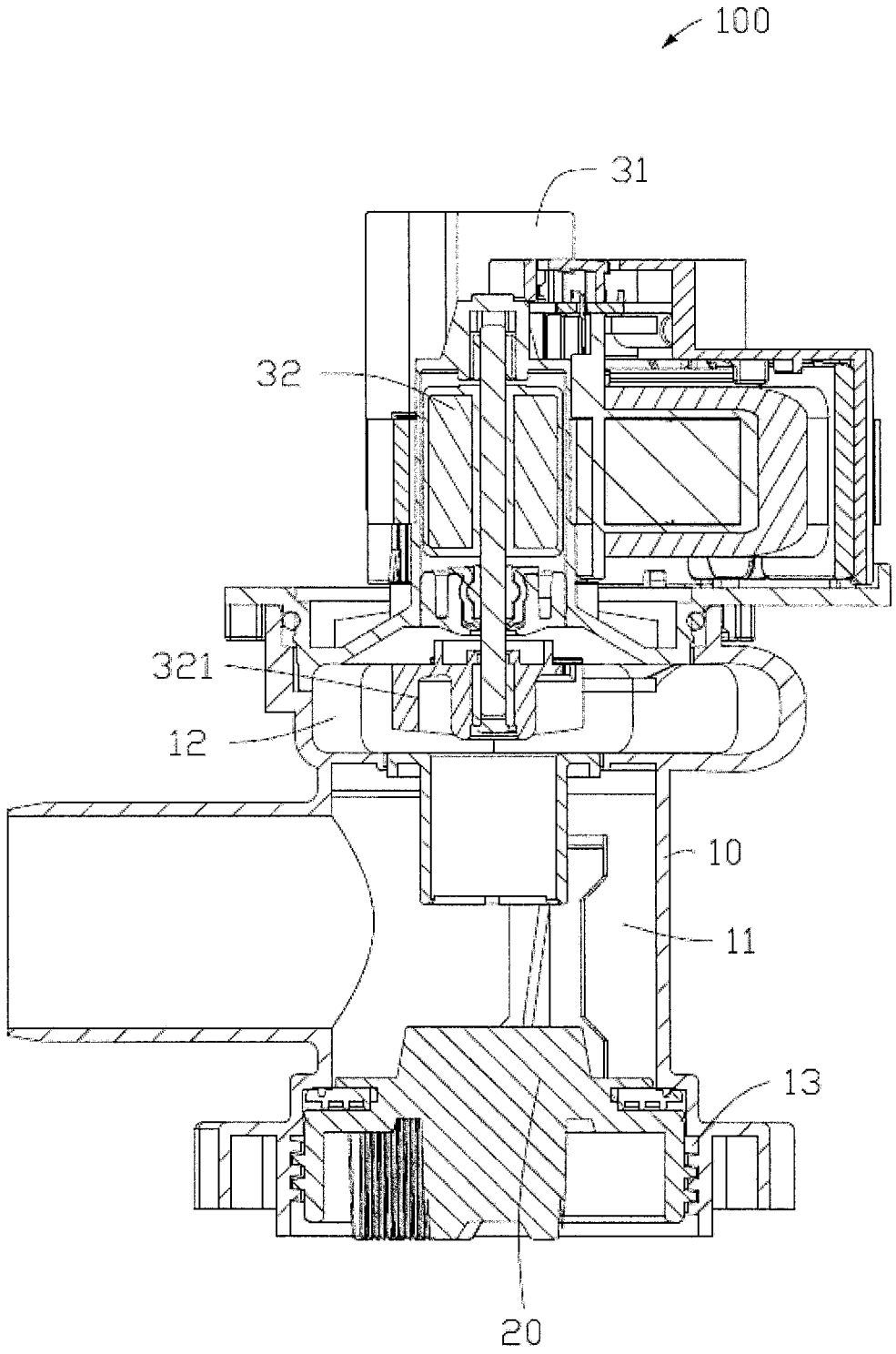
FIG. 2 is a sectional view of the drain pump of FIG. 1, taken along line II-II thereof.
Figure 3:
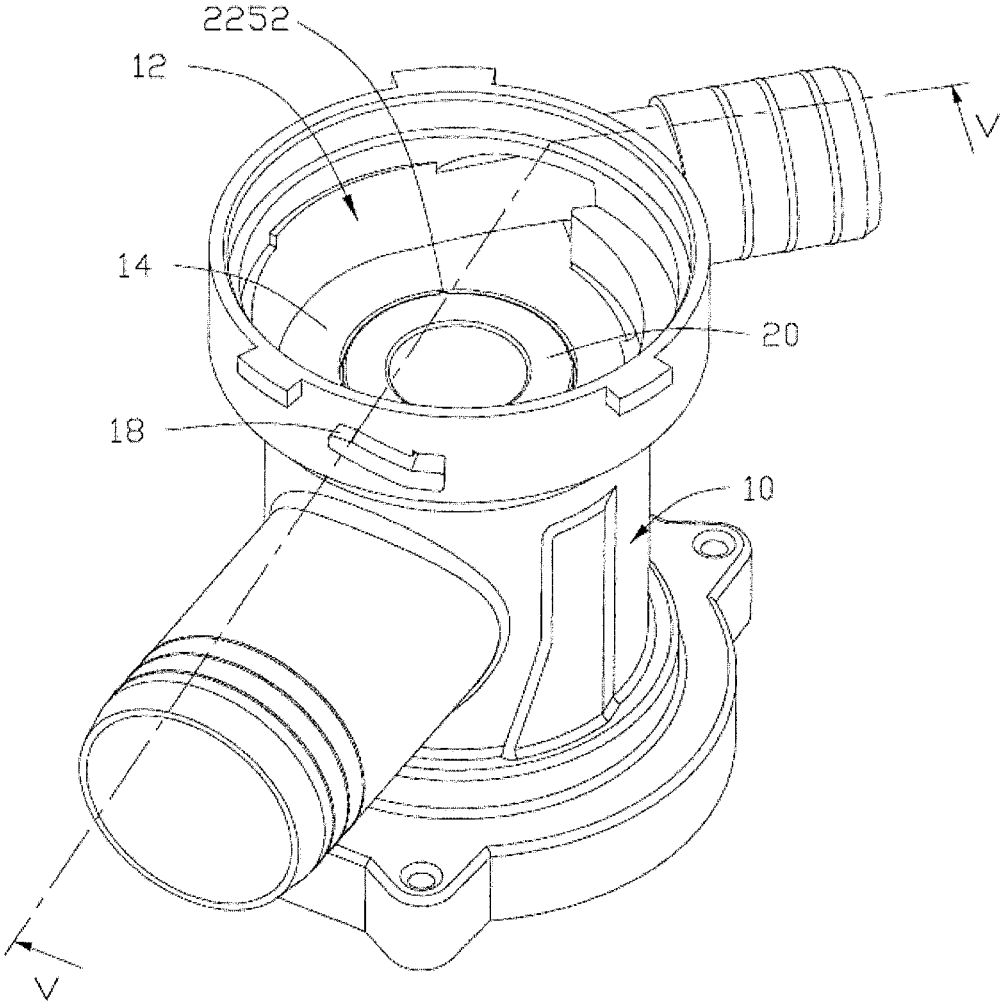
FIG. 3 is a perspective view of a pump housing and a filter of FIG. 1.
Figure 4:
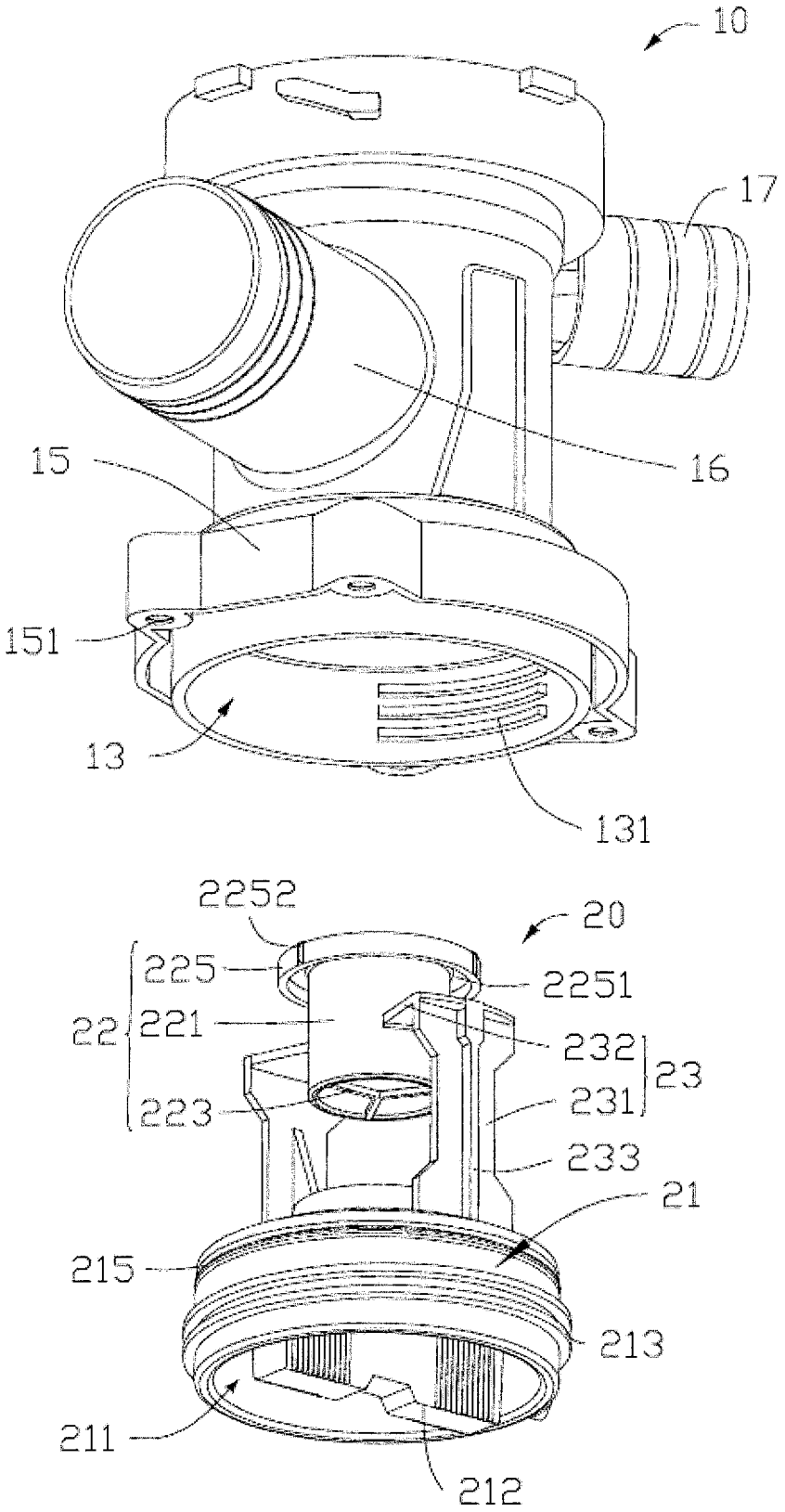
FIG. 4 is an exploded view of the pump housing and the filter of FIG. 3.
Figure 5:
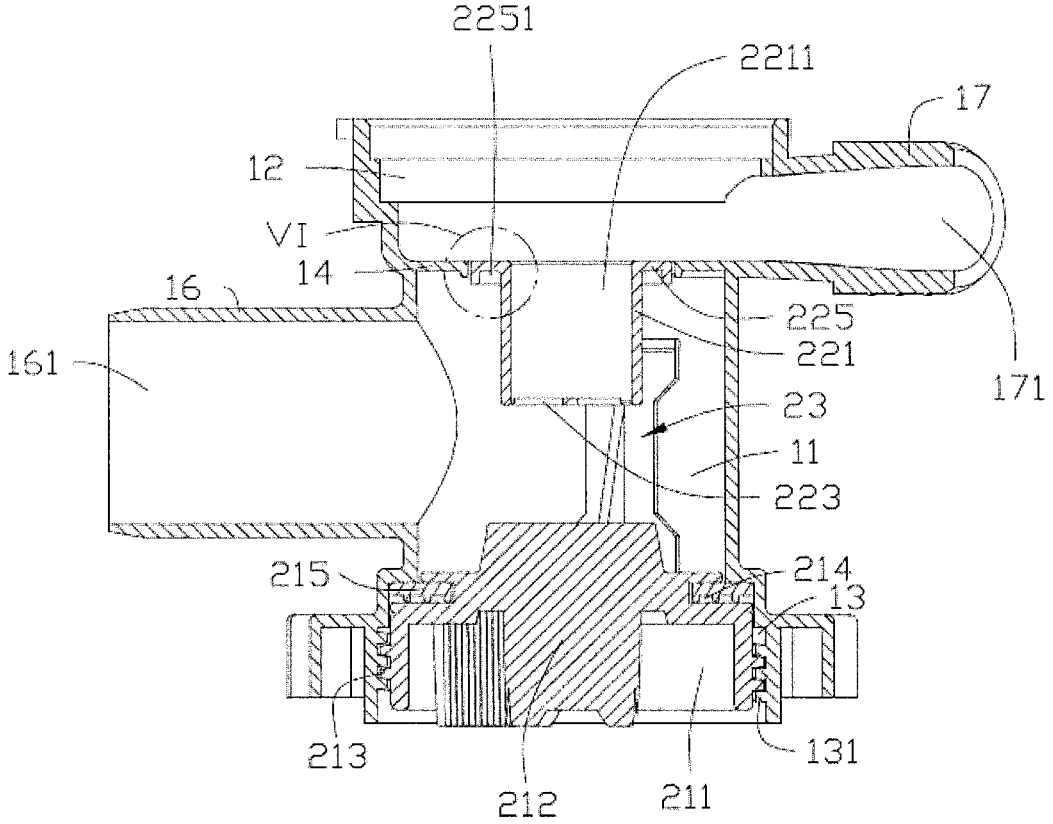
FIG. 5 is a sectional view of the pump housing and the filter of FIG. 3, taken along line V-V thereof.
Figure 6:
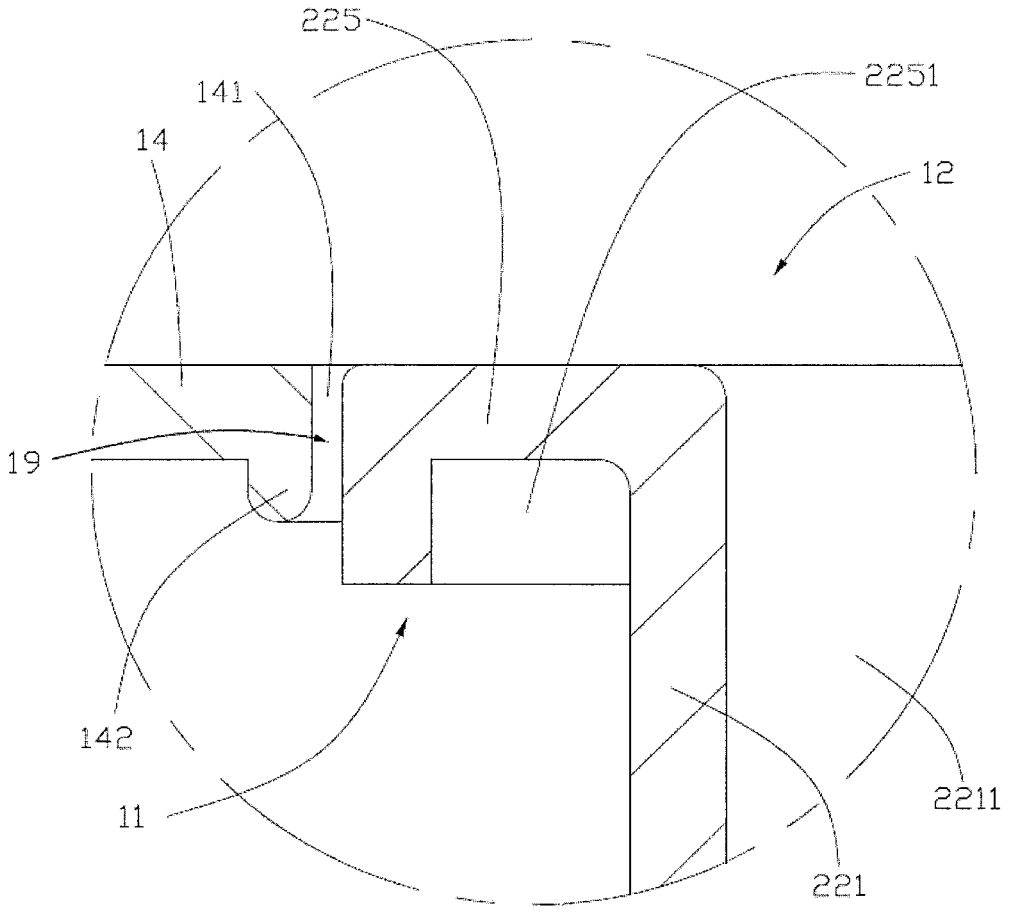
FIG. 6 is an enlarged view of the portion VI of FIG. 5.

Referring to FIG. 1 and FIG. 2, a drain pump 100 in accordance with one embodiment of the present disclosure includes a pump housing 10, a filter 20, and a motor assembly 30. The filter 20 is mounted in the pump housing 10. The motor assembly 30 is mounted at one end of the pump housing 10.

The motor assembly 30 includes a mounting housing 31 and a motor 32. The mounting housing 31 is fixedly connected to the pump housing 10 so that the motor 32 is fixed relative to the pump housing 10. One end of the motor 32 is coupled with an impeller 321 of the drain pump 100. The impeller 321 is accommodated in the pump housing 1.

Preferably, the motor 32 may be, but not limited to, a single phase brushless direct current motor, a three phase brushless direct current motor or a single phase synchronous motor.

It should be understood that the mounting housing 31 and the pump housing 10 may be connected through snap fit or screw connection.

Referring also to FIGS. 3-6, the pump housing 10 is generally in the form of a hollow cylinder and defines a filtering cavity 11, an impeller cavity 12 and a sealing cavity 13. The impeller cavity 12 and the sealing cavity 13 are located respectively at opposite two ends of the filtering cavity 11, and the filtering cavity 11, the impeller cavity 12 and the sealing cavity 13 are in communication with each other. The filtering cavity 11 is a circular cavity, the impeller cavity 12 is a stepped circular cavity, the impeller cavity 12 is located at one end of the filtering cavity 11, and the impeller 321 is accommodated in the impeller cavity 12. An annular plate 14 extends from an inner surface of the pump housing 10 in a radial direction of the pump housing 10. The annular plate 14 is disposed between the filtering cavity 11 and the impeller cavity 12 and defines a through hole 141 in a center area thereof. In the embodiment, a side of the annular plate 14 facing the filtering cavity 11 is further provided with an annular protrusion 142 surrounding the through hole 142. The sealing cavity 13 is a circular cavity and is greater than the filtering cavity 11 in radius. The pump housing 10 includes a plurality of first threads 131 on an inner surface of the pump housing 10 that defines the sealing cavity 13. The first threads 131 extend along a circumferential direction of the inner surface of the pump housing 10 and are arranged at even intervals. In this embodiment, the first threads 131 include three groups, with each group including three coaxially arranged teeth.

In the embodiment, the pump housing 10 includes a mounting block 15 disposed on an outer circumferential surface of the pump housing 10 adjacent the sealing cavity 13. The mounting block 15 is generally rectangular in shape, with connecting holes 151 defined in four corners of the mounting block 15. The pump housing 10 is connected to an external component by fixing members (not shown) passing through the connecting holes 151. The pump housing 10 includes a connecting block 18 disposed on the outer circumferential surface adjacent the impeller cavity 12. The connecting block 18 is generally L-shaped, with one end thereof connected to the outer circumferential surface of the pump housing 10.

An inlet pipe 16 and an outlet pipe 17 protrude radially from the outer circumferential surface of the pump housing 10. The inlet pipe 16 is connected to the outer circumferential surface of the pump housing 10. The inlet pipe 16 defines an interior inlet passage 161 in communication with the filtering cavity 11. The outlet pipe 17 is connected to the outer circumferential surface of the pump housing 10 adjacent the impeller cavity 12. The outlet pipe 17 defines an interior outlet passage 171 in communication with the impeller cavity 12.

The filter 20 is mounted in the filtering cavity 11 and the sealing cavity 13. The filter 20 includes a sealing member 21, a filter core 22, and multiple connecting members 23. The sealing member 21 and the filter core 22 are connected through the connecting members 23. The sealing member 21, the filter core 22 and the connecting members 23 may be integrally formed.

The sealing member 21 is of a circular truncated cone. A receiving slot 211 is defined in an end of the sealing member 21 opposite from the filter core 22. A handle portion 212 protrudes from a bottom of the receiving slot 211. The handle portion 212 is generally of a rectangular block. A plurality of second threads 213 are formed on an outer circumferential surface of the sealing member 21, corresponding to the first threads 131. The second threads 213 continuously extend around the outer circumferential surface of the sealing member 21. The filter 20 and the pump housing 10 are connected through thread engagement between the first threads 131 and the second threads 213. A groove 214 is defined in the outer circumferential surface of one end of the sealing member 21 adjacent the connecting members 23. An annular gasket 215 is mounted in the groove 214. The annular gasket 215 is made from a flexible material such as rubber or silicon rubber.

The filter core 22 includes a filter housing 221 and a filter mesh 223. The filter housing 221 is of an annular hollow cylinder and defines a filter hole 2211. The filter mesh 223 is connected with the filter housing 221 and positioned at one end of the filter hole 2211 adjacent the sealing member 21. In this embodiment, the filter mesh 223 includes three straight bars connected in a Y-configuration. The three straight bars divide a cross section of the filter housing 221 into three sectors with identical area. A bent plate 225 extends radially from and surrounds an outer side surface of one end of the filter housing 221 opposite from the filter mesh 223. The bent plate 225 has a generally L-shaped cross section. The bent plate 225 is bent inwardly, with a groove 2251 defined between the bent plate 225 and the filter housing 221. An outer circumferential surface of the bent plate 225 is provided with a plurality of protruding posts 2252. Each protruding post 2252 extends in an axial direction of the filter core 22 and abuts against an inner surface of the annular plate 14. In this embodiment, there are three protruding posts 2252 which are spaced evenly to maintain a stability of the filter core 22.

It should be understood that the filter mesh 223 may have another configuration such as a cruciform configuration.

Each connecting member 23 is generally L-shaped and includes a first connecting plate 231 and a second connecting plate 232 that are substantially perpendicular to each other. The first connecting plate 231 is generally I-shaped, with one end thereof connected to the sealing member 21 and the other end connected to the second connecting plate 232. The first connecting plate 231 is further formed with a reinforcing rib 233 for reinforcing the connecting strength of the connecting member 23. One end of the second connecting plate 232 away from the first connecting plate 231 is connected to the filter core 22. In this embodiment, there are two connecting members 23 which are symmetrically disposed at opposite sides of the filter core 22.

In assembly of the filter 20 and the pump housing 10, the handle portion 212 is inserted into the filtering cavity 11 from one end of the filter 20 having the filter core 22. The sealing member 21 of the filter 20 is accommodated in the sealing cavity 13 and the gasket 215 abuts against the pump housing 10. The filter 20 is fixedly connected to the pump housing 10 through thread engagement between the first threads 131 and the second threads 213. At this time, the bent plate 225 extends into the through hole 141 of the annular plate 14, with the protruding posts 2252 abutting against the inner surface of the annular plate 14, such that the filter core 22 is further fixed relative to the pump housing 10, and a gap 19 in communication with the filtering cavity 11 and the impeller cavity 12 is defined between the bent plate 225 and the annular plate 14.

In the drain pump 100 of one embodiment of the present disclosure, the gap 19 in communication with the filtering cavity 11 and the impeller cavity 12 is defined between the bent plate 225 and the annular plate 14. Therefore, near the end of the drainage process of the drain pump 100, air-mixed water struck on the sidewall of the impeller cavity 12 under the action of the centrifugal force of the impeller 321 may flow back into the filtering cavity 11 and the inlet passage 161 via the gap 19 between the filtering cavity 11 and the impeller cavity 12. In this way, the air-mixed water struck on the sidewall of the impeller cavity 12 may undergo pressure relief, thus effectively reducing the noise of the drain pump 100 generated during the drainage process (particularly near the end of the drainage process).

It should be understood the gap 19 between the filtering cavity 11 and the impeller cavity 12 may be directly formed by the filter housing 221 and the inner surface of the pump housing 10, in which case the annular plate 14 and the bent plate 225 may be omitted.

Figure 7:
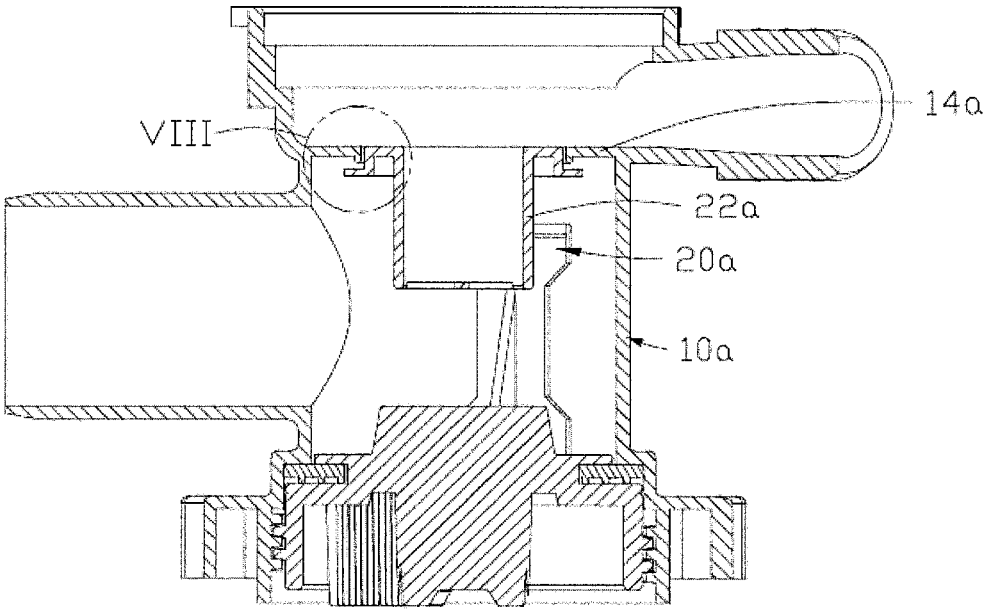
FIG. 7 is a sectional view of a pump housing and a filter according to another embodiment of the present disclosure.

Referring to FIG. 7, FIG. 7 is a sectional view of a pump housing 10*a* and a filter 20*a* according to another embodiment of the present disclosure. This embodiment differs from the embodiment of FIG. 5 in that the structure of the filter core 22*a* of the filter 20*a* is different from the structure of the filter core 22.

Figure 8:
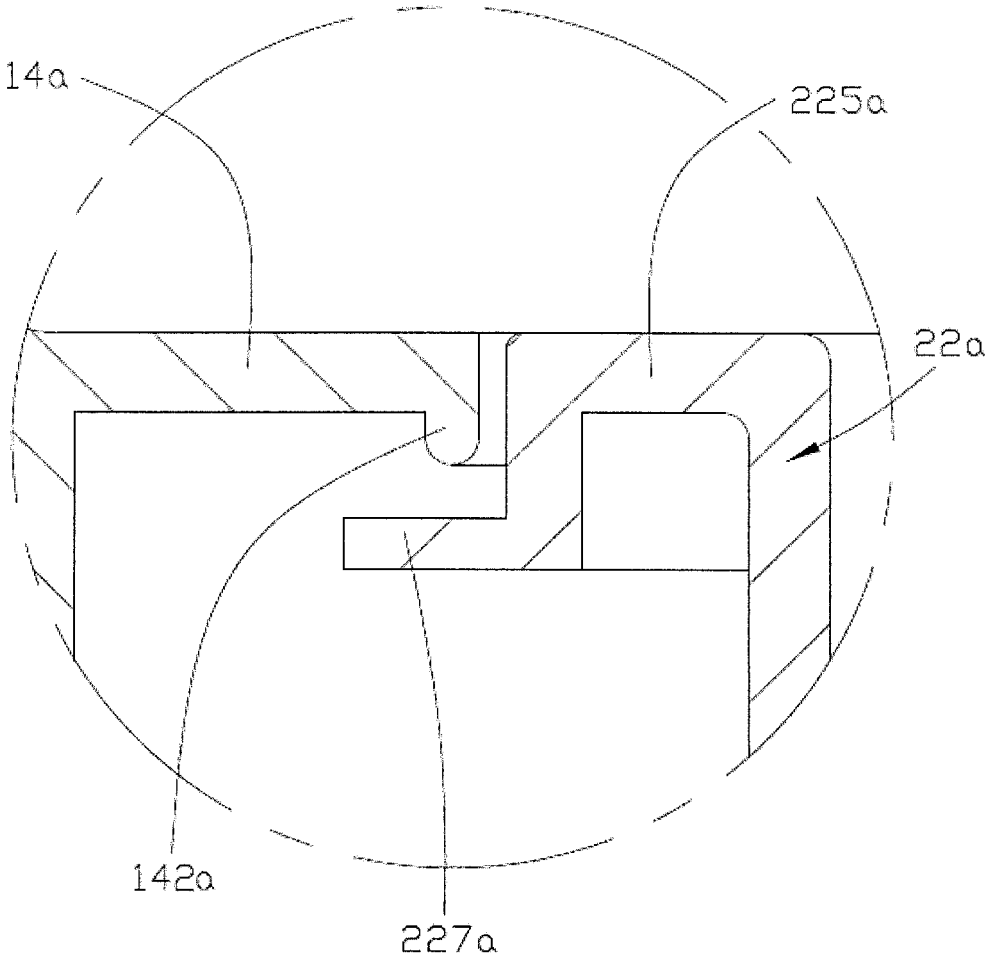
FIG. 8 is an enlarged view of the portion VIII of FIG. 7.

Referring to FIG. 8, FIG. 8 is an enlarged view of portion VIII of FIG. 7. A baffle 227*a* is formed surrounding the outer circumferential surface of the bent plate 225*a* of the filter 22*a*. The baffle 227*a* extends radially from the filter core 22*a*. The baffle 227*a* is disposed at one side of the bent plate 225*a* away from the annular plate 14*a*, and the baffle 227*a* and the annular protrusion 142*a* are opposed to each other.

Figure 9:
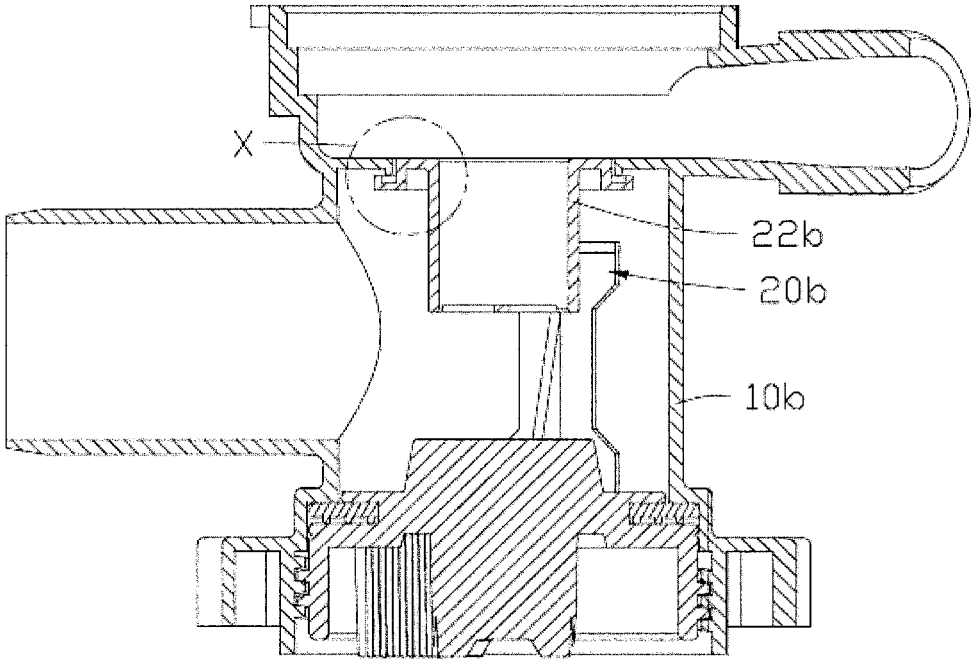
FIG. 9 is a sectional view of a pump housing and a filter according to another embodiment of the present disclosure.

Referring to FIG. 9, FIG. 9 is a sectional view of a pump housing 10*b* and a filter 20*b* according to another embodiment of the present disclosure. The structure of the filter core 22*b* of the filter 20*b* is different from the structure of the filter core 22.

Figure 10:
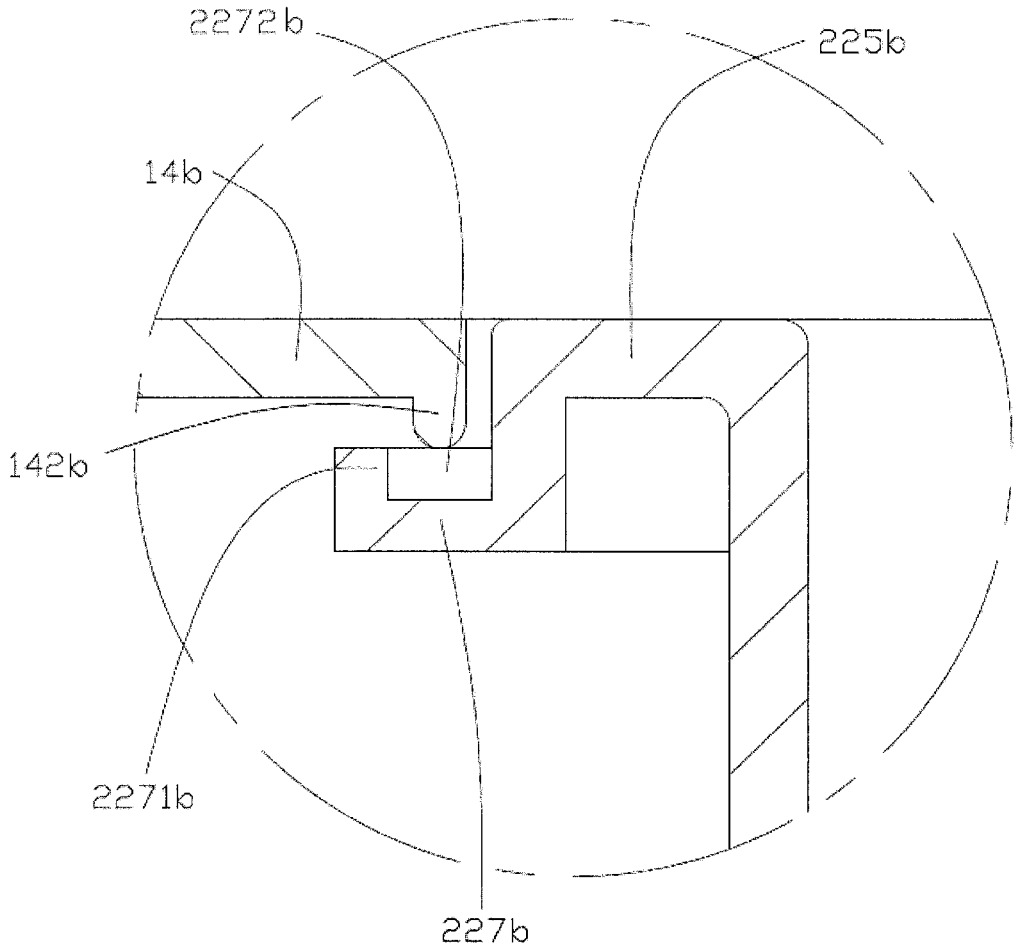
FIG. 10 is an enlarged view of the portion X of FIG. 9.

Referring to FIG. 10, FIG. 10 is an enlarged view of portion X of FIG. 9. A baffle 227*b* is formed surrounding the outer circumferential surface of the bent plate 225*b* of the filter 22*b*. The baffle 227*b* extends radially from the filter core 22*b*. The baffle 227*b* is disposed at one side of the bent plate 225*b* away from the annular plate 14*b*, and the baffle 227*b* and the annular protrusion 142*b* are opposed to each other. One side of the baffle 227*b* facing the annular plate 14*b* is provided with an annular protruding block 2271*b* which is spaced from the bent plate 225*b*. The protruding block 2271*b*, the baffle 227*b* and the bent plate 225*b* together define an annular groove 2272*b*. The annular protrusion 142*b* is aligned with the annular groove 2272*b*. The filtering cavity 11 and the impeller cavity 12 communicate with each other via the gap 19 and the groove 2272*b*.

Figure 11:
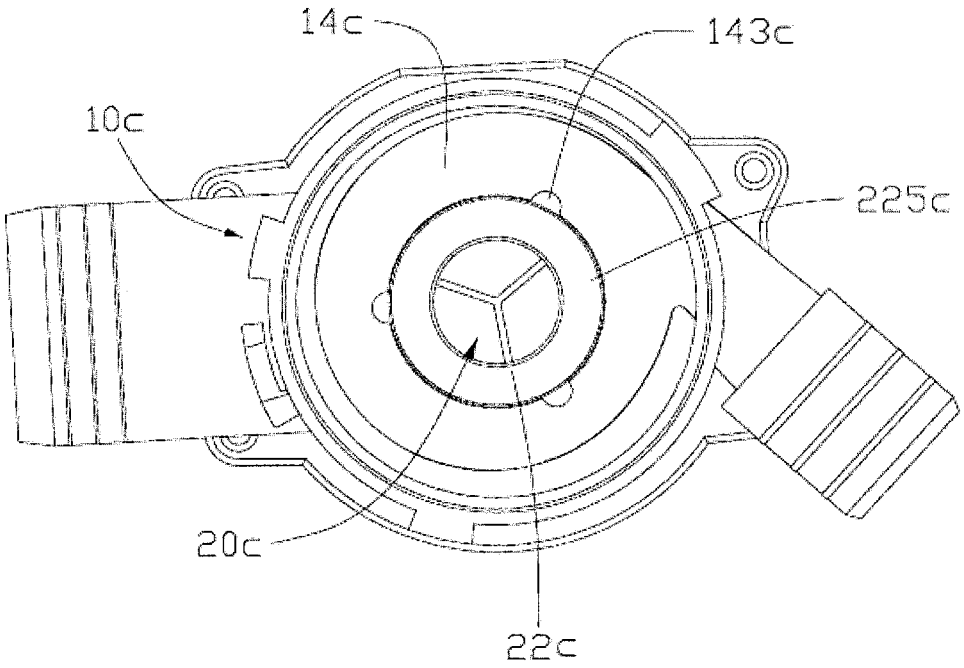
FIG. 11 is a top view of a pump housing and a filter according to another embodiment of the present disclosure.

Referring to FIG. 11, FIG. 11 is a top view of a pump housing 10*c* and a filter 20*c* according to a fourth embodiment of the present disclosure. The structure of an annular plate 14*c* of the pump housing 10*c* is different from the structure of the annular plate 14, and a structure of a filter core 22*c* of a filter 20*c* is different from the structure of the filter core 22.

No protruding post is disposed on the outer circumferential surface of the bent plate 225*c* of the filter core 22*c*, and the bent plate 225*c* abuts against the inner surface of the annular plate 14*c*. The inner surface of the bent plate 14*c* defines a plurality of pressure relief grooves 143*c*. Each pressure relief groove 143*c* is arc-shaped, and the filtering cavity 11 and the impeller cavity 12 communicate with each other via the pressure relief grooves 143*c*. The pressure relief grooves 143*c* form the gap. A number of the pressure relief grooves 143*c* may be determined according to a desired optimal air pressure balance result. In this embodiment, a number of the pressure relief grooves 143*c* is three.

Figure 12:
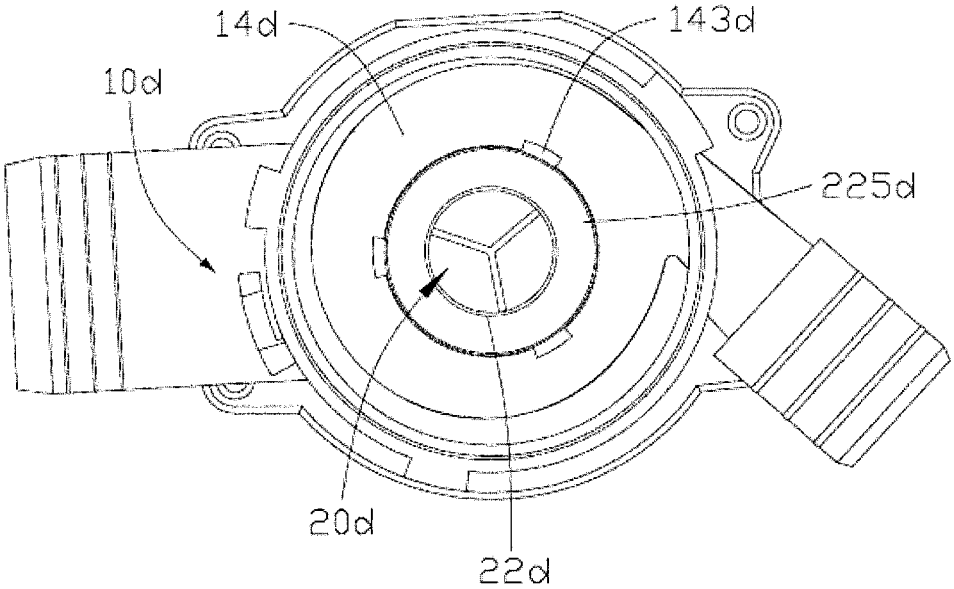
FIG. 12 is a top view of a pump housing and a filter according to another embodiment of the present disclosure.

Referring to FIG. 12, FIG. 12 is a top view of a pump housing 10*d* and a filter 20*d* according to another embodiment of the present disclosure. A structure of an annular plate 14*d* of the pump housing 10*d* is different from the structure of the annular plate 14, and a structure of a filter core 22*d* of a filter 20*d* is different from the structure of the filter core 22.

No protruding post is disposed on the outer circumferential surface of the bent plate 225*d* of the filter core 22*d*, and the bent plate 225*d* abuts against the inner surface of the annular plate 14*d*. The inner surface of the bent plate 14*d* defines a plurality of pressure relief grooves 143*d*. Each pressure relief groove 143*d* is dovetail-shaped, and the filtering cavity 11 and the impeller cavity 12 communicate with each other via the pressure relief grooves 143*d*. The pressure relief grooves 143*d* form the gap. A number of the pressure relief grooves 143*d* may be determined according to a desired optimal air pressure balance result. In this embodiment, a number of the pressure relief grooves 143*d* is three.

Figure 13:
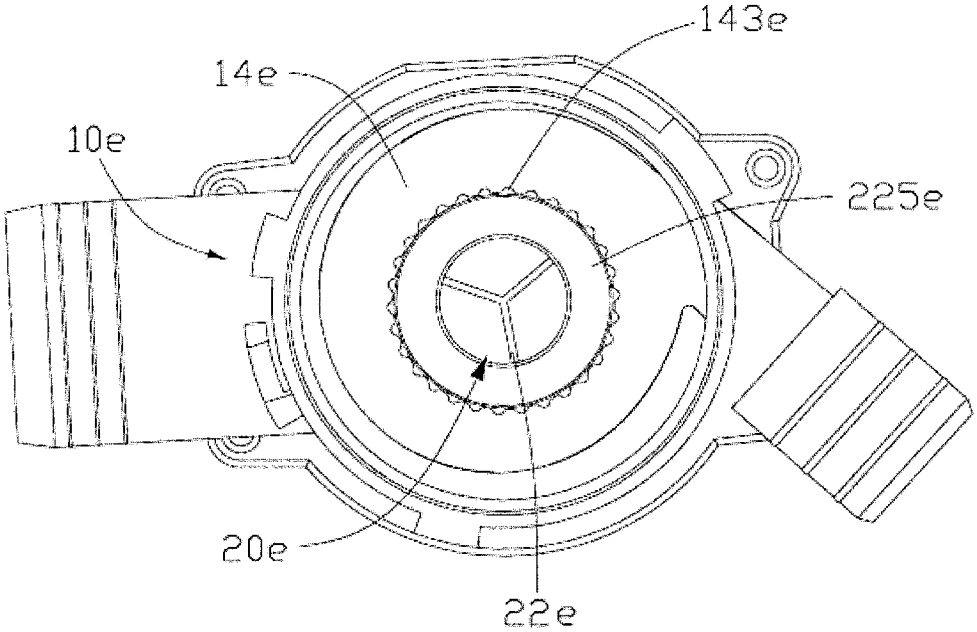
FIG. 13 is a top view of a pump housing and a filter according to another embodiment of the present disclosure.

Referring to FIG. 13, FIG. 13 is a top view of a pump housing 10*e* and a filter 20*e* according to another embodiment of the present disclosure. A structure of an annular plate 14*e* of the pump housing 10*e* is different from the structure of the annular plate 14, and a structure of a filter core 22*e* of the filter 20*e* is different from the structure of the filter core 22.

No protruding post is disposed on the outer circumferential surface of the bent plate 225*e* of the filter core 22*e*, and the bent plate 225*e* abuts against the inner surface of the annular plate 14*e*. The inner surface of the bent plate 14*e* defines a plurality of circumferentially-arranged pressure relief grooves 143*e*. The pressure relief grooves 143*e* are arranged circumferentially along the inner surface of the annular plate 14*e* and are serrated grooves, and the filtering cavity 11 and the impeller cavity 12 communicate with each other via the pressure relief grooves 143*e*. The pressure relief grooves 143*e* form the gap.

The pressure relief groove of the present disclosure is not limited to the shapes described above, and may also be triangular, rectangular, trapezoidal, another irregular shape, or combination of different shapes.

Figure 14:
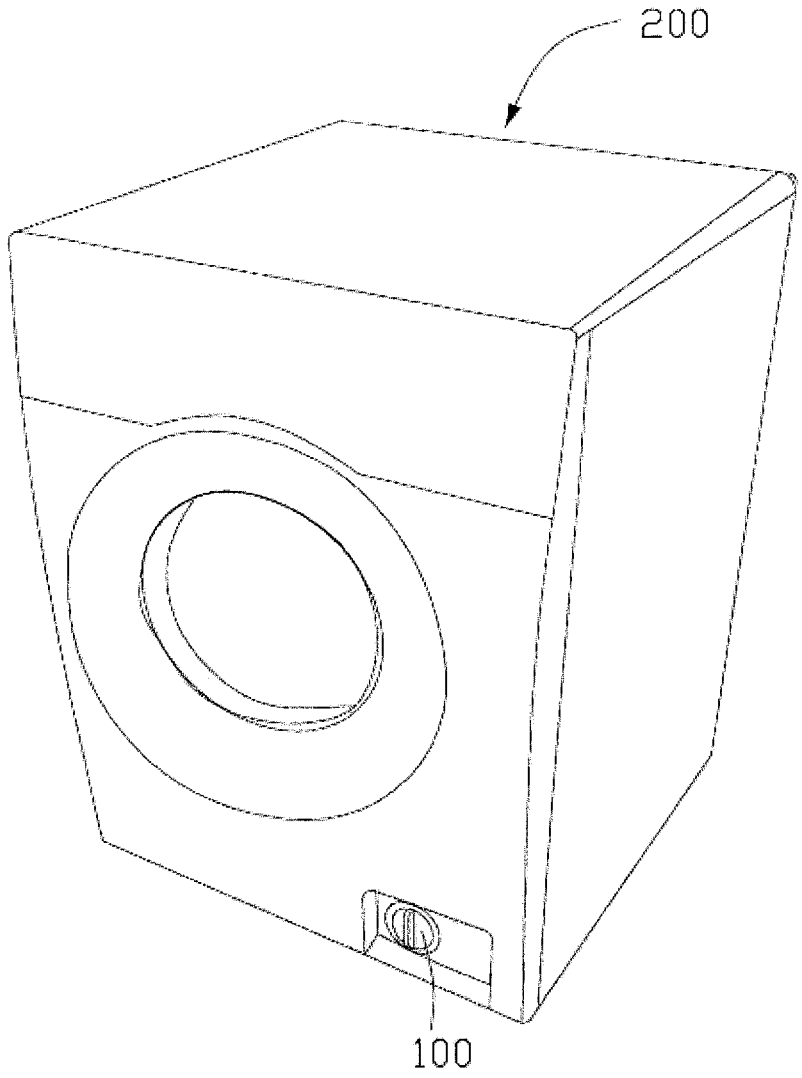
FIG. 14 is a perspective view of a home appliance of the present disclosure.

Referring to FIG. 14, FIG. 14 illustrates the drain pump 100 of the present disclosure being utilized in a home appliance 200. In this embodiment, the home appliance 200 can be a washing machine.

It should be understood that the drain pump 100 may also be utilized in another home appliance such as a dishwasher.

The embodiments described above are preferred embodiments of the present disclosure, and should not be used to limit the scope of the present disclosure in any way. Various other modifications can be apparent to persons skilled in the field without departing from the scope of the invention, and all of such modifications should fall within the scope of the present disclosure.

The invention claimed is:

1. A drain pump comprising:

a pump housing having a filtering cavity and an impeller cavity;

a filter mounted in the pump housing and having a filter core; wherein the filter core comprises a filter housing being of an annular hollow cylinder, and a filter hole is defined in the filter housing; and a gap defined between the filter housing and the pump housing to communicate the filtering cavity and the impeller cavity, wherein an annular plate is disposed in the pump housing between the filtering cavity and the impeller cavity, the annular plate defines a through hole, one end of the filter core is accommodated in the through hole, and the gap is defined between the filter core and the annular plate.

2. The drain pump of claim 1, wherein the filter core comprises a bent plate, the bent plate surrounds an outer circumferential surface of the filter housing, and the gap is formed between the bent plate and the annular plate.

3. The drain pump of claim 2, wherein an outer circumferential surface of the bent plate is provided with a plurality of protruding posts abutting against an inner surface of the annular plate.

4. The drain pump of claim 2, wherein a baffle extends radially from the filter core, and the baffle and the annular plate are opposed to each other.

5. The drain pump of claim 4, wherein the annular plate forms an annular protrusion extending toward to the baffle, and the annular protrusion surrounds the through hole and is opposed to the baffle.

6. The drain pump of claim 5, wherein an annular protruding block is arranged in the baffle to face the annular plate; the annular protruding block, the baffle and the bent plate together define an annular groove; the annular protrusion is aligned with the annular groove, and the filtering cavity, the impeller cavity, the gap, and the annular groove communicate with each other.

7. The drain pump of claim 2, wherein the bent plate abuts against an inner surface of the annular plate, an inner surface of the bent plate defines a plurality of pressure relief grooves which form the gap, and the pressure relief grooves communicate the filtering cavity with the impeller cavity.

8. The drain pump of claim 7, wherein the pressure relief grooves are circular arc-shaped, dovetail-shaped, or serrated grooves arranged circumferentially along the inner surface of the annular plate.

9. The drain pump of claim 2, wherein the filter core further comprises a filter mesh connected with the filter housing, and the filter mesh is disposed in one end of the filter hole opposite from the impeller cavity.

10. The drain pump of claim 1, wherein the filter further comprises a sealing member and a plurality of connecting members, the sealing member is connected to the filter core through the connecting members, the pump housing further comprises a sealing cavity disposed at one end of the filtering cavity opposite from the impeller cavity, and the sealing member is accommodated in the sealing cavity and connected with the pump housing.

11. The drain pump of claim 10, wherein the sealing member connected with the pump housing via a thread engagement.

12. The drain pump of claim 1, wherein the drain pump further comprises a motor assembly including a mounting housing and a motor, the motor is mounted in the mounting housing, the mounting housing is fixedly connected to the pump housing, one end of the motor is connected with an impeller, and the impeller is accommodated in the impeller cavity.

13. The drain pump of claim 12, wherein the motor is a single phase brushless direct current motor, a three phase brushless direct current motor, or a single phase synchronous motor.

14. The drain pump of claim 1, wherein an inlet pipe and an outlet pipe protrude from an outer circumferential surface of the pump housing, the inlet pipe defines an inlet passage in communication with the filtering cavity, and the outlet pipe defines an outlet passage in communication with the impeller cavity.

15. A home appliance comprising a drain pump, the drain pump comprising:

a pump housing having a filtering cavity and an impeller cavity;

a filter mounted in the pump housing and having a filter core; wherein the filter core comprises a filter housing being of an annular hollow cylinder, and a filter hole is defined in the filter housing; and a gap defined between the filter housing and the pump housing to communicate the filtering cavity and the impeller cavity, wherein an annular plate is disposed in the pump housing between the filtering cavity and the impeller cavity, the annular plate defines a through hole, one end of the filter core is accommodated in the through hole, and the gap is defined between the filter core and the annular plate.

16. The home appliance of claim 15, wherein the home appliance is a washing machine or a dishwasher.

17. A drain pump comprising:

a pump housing having a filtering cavity and an impeller cavity;

a filter mounted in the pump housing and having a filter core; wherein the filter core comprises a filter housing and a bent plate, and a filter hole is defined in the filter housing, the bent plate surrounds an outer circumferential surface of the filter housing, an annular plate is disposed in the pump housing between the filtering cavity and the impeller cavity, the annular plate defines a through hole, one end of the filter core is accommodated in the through hole; and a gap defined between the bent plate and the annular plate to communicate the filtering cavity and the impeller cavity; and wherein the bent plate abuts against an inner surface of the annular plate, an inner surface of the bent plate defines a plurality of pressure relief grooves which form the gap, and the pressure relief grooves communicate the filtering cavity with the impeller cavity.

* * * * *